United States Patent [19]

Stog et al.

[11] Patent Number: 4,647,342

[45] **Date of Patent: * Mar. 3, 1987**

[54] LIGHTWEIGHT FLEXIBLE COKE OVEN DOOR WITH PRESSURE-BALANCING LEVER SYSTEM

[75] Inventors: Wilhelm Stog; Jochen Stog, both of Waltrop, Fed. Rep. of Germany

[73] Assignee: WSW Planungs GmbH, Waltrop, Fed. Rep. of Germany

[ * ] Notice: The portion of the term of this patent subsequent to Mar. 3, 2004 has been disclaimed.

[21] Appl. No.: 606,509

[22] Filed: May 3, 1984

[30] Foreign Application Priority Data

May 4, 1983 [DE] Fed. Rep. of Germany ..... 3316247
Dec. 13, 1983 [DE] Fed. Rep. of Germany ..... 3344976

[51] Int. Cl.[4] ..... C10B 25/06
[52] U.S. Cl. ..... 202/242; 202/248
[58] Field of Search ..... 202/248, 242, 247; 432/242, 250, 251; 110/173 R, 176

[56] References Cited

U.S. PATENT DOCUMENTS

| | | | |
|---|---|---|---|
| 1,827,329 | 10/1931 | Otto . | |
| 2,878,170 | 3/1959 | Forsans | 202/247 |
| 3,933,598 | 1/1976 | Pries | 202/248 |
| 4,002,537 | 1/1977 | Calderon | 202/248 |
| 4,086,145 | 4/1978 | Muller | 202/248 |
| 4,400,240 | 8/1983 | Abendroth | 202/248 |
| 4,414,072 | 11/1983 | Breidenbach | 202/248 |
| 4,422,902 | 12/1983 | Breidenbach | 201/14 |
| 4,502,922 | 3/1985 | Stewen | 202/248 |
| 4,532,010 | 7/1985 | Dürslen et al. | 202/248 |

FOREIGN PATENT DOCUMENTS

| | | | |
|---|---|---|---|
| 1809880 | 6/1970 | Fed. Rep. of Germany | 202/248 |
| 2654375 | 4/1978 | Fed. Rep. of Germany | 202/248 |
| 2755020 | 6/1979 | Fed. Rep. of Germany | 202/248 |
| 3138406 | 5/1983 | Fed. Rep. of Germany . | |

*Primary Examiner*—Jan Silbaugh
*Assistant Examiner*—Jennifer Cabaniss
*Attorney, Agent, or Firm*—Joseph J. O'Keefe

[57] ABSTRACT

A lightweight, flexible oven door for horizontal coke ovens consisting of a thin-walled, flexible sealing plate, door body, a coking plate assembly extending into the oven from the sealing plate door body, knife edges mounted on the inner periphery of the sealing plate door body and adapted to be pressed against the coke oven door frame, and a plurality of flexible pressure-balancing lever systems that cooperate with the door locking bar assemblies and locking hooks. Each of the flexible pressure-balancing lever systems applies pressure at several points along the outer periphery of the sealing plate door body to press the knife edges on the underside thereof against the door frame to seal the oven against the atmosphere. Each of the pressure balancing lever systems includes a plurality of flexibly interconnected levers.

10 Claims, 3 Drawing Figures

LIGHTWEIGHT FLEXIBLE COKE OVEN DOOR WITH PRESSURE-BALANCING LEVER SYSTEM

The invention pertains to a horizontal-chamber coke oven door with a door body consisting of an elastic, thin-walled sealing plate whose edge, which carries the sealing knife edge, is held on the oven frame by means of a sealing frame supported by locking bars, and with a coking plate that reaches into the oven, which coking plate is installed on the inner side of the sealing plate at a distance from it.

The coke oven doors that have been almost exclusively used thus far consist of a heavy casting that can weigh up to 5 tons and more. Such coke oven doors, which as a rule are equipped on the inner side with a ceramic plug approximately 0.4 m deep, are difficult to handle and require correspondingly complicated machines to operate them.

Unlike these known doors, the door known, for example from Federal Republic of Germany P. 31 38 406.4 weighs considerably less, so that it is easier to handle and can be positioned more accurately in front of the coke oven. The door body itself is connected with the chamber frame or pressed against it at more than two points. The known door consists of a sealing plate, which represents the actual door body and has knife edges at its periphery, which knife edges are pressed against the chamber frame by means of pressure elements, whereby these pressure elements bear against a continuous sealing frame made from a U-channel or from a similar shape and against the locking bars distributed over the height. In order to insure a uniform distribution of the bearing forces, six or more such locking bars are provided. Such a coke oven door weighs considerably less and is highly flexible, because the door body, as it is described, consists of only a thin-walled sealing plate. Therefore it easily fits to the existing shape of the oven frame. As is known, owing to the temperature effect, the oven frames and the door warp away from their position, whereby leaks can occur, since then the knife edge cannot be pressed sufficiently tightly against the oven frame. As stated, this is not the case with the known elastic doors having the sealing plate as the door body. The elasticity of the one-piece door body is further increased, and thereby its weight is reduced, by eliminating the ceramic plug on the inner side and instead providing a coking plate supported by spacers at a distance from the door body. It has been found that after long use, owing to the accumulation of dirt or other deleterious effects, the knife edge is no longer pressed uniformly by the pressure element. This pressure element, preferably an inflatable tube, must also be protected against relatively high temperatures and thus it represents a weak point of the entire door. Also, installation of locking bars over the height of the coke oven door is frequently complicated, particularly when existing coke ovens are to be retrofitted with the described door. It is of a further disadvantage that, owing to the use of the sealing frame, which resists bending and runs along the periphery of the door and which bears against the pressure element, such doors have an element that reduces flexibility and also increases the door weight.

The purpose of the invention is to provide a flexible coke oven door that insures a sure and reliable fit of the door body to the oven frame even at high temperatures and long service.

The purpose is achieved according to the invention in that the sealing frame is designed in the form of a pressure-balancing lever system, which pressure-balancing lever system is installed with respect to the sealing plate in such a manner that it acts on the sealing plate at points distributed at preselected distances over the length of the sealing plate.

Such coke oven doors are surprisingly light, which is attributable to the lightness of the sealing plate, which serves as the door body, and also to the coking plate, which serves, among other purposes, as a separator. Surprisingly, however, the entire door body is so flexible that it is able to perfectly fit the shape of the oven frame over its entire length. The sealing plate engages tightly the entire oven frame, or the knife edge on the sealing plate is able to insure tight sealing of the interior of the oven against the atmosphere over the entire height of the door. However, the flexibility of the entire door body offers not only the advantage of a tight fit of the door body against the more or less warped oven frame, but also makes it possible to compress or penetrate the dirt on the oven frame, because the individual segement of the sealing plate or of the knife edges can be pressed with a great force against the frame. This great force is produced by means of suitable devices and applied at many points of the door by means of the pressure-balancing lever system.

According to a practical design of the invention, the pressure balancing lever system consists of pressure-balancing levers fitting into one another and acting on one another and on both longitudinal edges of the sealing plate. These pressure-balancing levers insure as uniform as possible pressure transfer and bending of short lengths of the sealing plate according to the deformation of the oven frame. Furthermore, such a pressure-balancing lever system can be designed so that only a small weight increase of the entire system is achieved together with purposeful application or transmission of the pressure and with advantageous flexibility.

The flexibility and the necessary transmission of pressure when the pressure-balancing lever system is equipped with pressure-balancing levers which, together with the system's pads, bear against the sealing plate, which levers are flexibly connected with other pressure-balancing levers that serve as connecting or distributing levers. Such a pressure-balancing lever system is very flexible.

In order to insure sufficient flexibility without overly increasing the size, it is proposed according to the invention to construct the pressure-balancing lever system in separate parts and to install them in conjunction with either side of each locking bar. Thus, in the case of the usual coke oven door with two locking bars, four pressure balancing lever systems are used, which systems are usually of the same design and are interchangeable. Furthermore, by means of properly constructed pressure-balancing lever systems, it is possible to apply the necessary force on the sealing plate and the knife edge advantageously over short distances. Then each pressure-balancing lever system is advantageously equipped with four pressure-balancing lever each acting with two pads on the sealing plate, which levers connect with the locking bar via connecting levers and the distributing levers. Since the pressure-balancing levers, and the connecting and distributing levels, fit into one another the result is a unit that is not very high and it acts at eight points of the sealing plate, so that, in the case of an approximately 6 m high door, the sealing plate and thus the knife edge are pressed against the oven frame at 32 points as viewed over the height and on both sides. This results, as described previously, in balanced pressing of the flexible sealing plate against the more or less deformed door oven frame.

The necessary pressure is produced in a simple manner and on pressure-balancing lever systems on both longitudinal sides, or transmitted to these levers systems, in that, according to the invention, the pressure-balancing lever systems associated with a locking bar are connected to one another by means of a bridge part whose distance from the locking bar can be varied by an adjusting mechanism. Conveniently, this adjusting mechanism is a spindle that can be operated in a simple manner by the door lifting machine. The spindles of both locking bars are actuated simultaneously, whereby balanced and simultaneous pressing of the sealing plate is insured.

In order to fix the pressure-balancing lever systems on the sealing plate, the pads of the pressurebalancing levers associated with the upper edge of the sealing plate are joined to the sealing plate. The same applies also to the pressure-balancing lever systems associated with the lower locking bar. However, in this case it may be appropriate to add several slide guides installed on the sealing plate, which slide guides can be constructed so that they contribute to the fixing of the pressure-balancing lever system. In this manner, it is effectively and simply insured that the individual lever systems are always placed at the preselected points and thus transmit the pressure at these points to the knife edge through the sealing plate.

Experience shows that leaks are most likely to occur at the upper and lower ends of the door. This is due to the fact that the door frames usually buckle near the middle, and therefore the coke oven door and the knife edges must undergo and accept the largest deflection. These problems, in the manner described, do not occur with the new lightweight door because the sealing plate, which serves as the door body, and the pressure-equalizing link system are very flexible. In order to apply by means of this lever system the various forces necessary at various points, the invention provides that the levers are of different lengths. Owing to the different lengths, it is possible, for example, to apply more pressure at the ends of the sealing plate than at the center. For this purpose, it is appropriate to vary the lengths of the pressure-balancing levers so that they increase from the ends to the center of the sealing plate. This results in the largest pressures being applied at the upper and lower ends of sealing plate.

To protect the sealing plate and to prevent distortion or similar damage, it is appropriate to insulate the sealing plate by means of an insulating layer toward the knife edge as well as toward the distributor plate or the pads.

A design, according to which an insulating mat is provided on the inner and the outer faces of the sealing plate, also serves to protect the door body. Other doors known thus far also feature an insulating mat on the inner face. The primary purpose of the mat has been to insure that the gas flowing upward between the mat and the coking plate does not cool in the direction of this inner face. The insulating mat on the outer face now protects the mechanisms installed on the outer face and results in approximately the same temperatures on the inner and outer faces of the sealing plate, so that the sealing plate retains its shape over the entire height. The insulating mat can be installed in a particularly advantageous manner when the sealing plate is dished so that it protrudes into the door opening, and the insulating mat is placed in the resulting depression. The dishing also stiffens the thin-walled sealing plate, which is advantageous for handling of the door.

The invention is distinguished particularly by the fact that the service life can be increased owing to appropriate application of pressures on the sealing plate. The high flexibility of the entire door is thereby increased, so that accurate fit of the sealing plate with respect to the door frame over the entire height of the door is provided. Without significantly increasing the height of the apparatus installed on the sealing plate, the pressure-balancing lever system is installed so that it insures the desired fit of the sealing plate to the shape of the oven frame over the entire height. In the case of the design in which the pressure is applied in the middle by means of spindles or similar apparatus, it is possible to reuse the existing equipment when the ovens are retrofitted. The door body that is flexible over its entire area makes it possible to fit the entire door to the shape of the oven frame and thus insures a complete sealing of the coke oven against the atmosphere. Even the critical upper and lower ends are secured, since the pressures are increased at these ends by more closely spaced pads of the pressure-balancing levers and because the pressure elements insure uniform sealing also in this area owing to the arrangement of the locking bars and the pressure-balancing levers.

Further details and advantages of the subject of the invention follow from the description of the appropriate drawing, which show examples of preferred designs with the necessary details.

Figure 1:
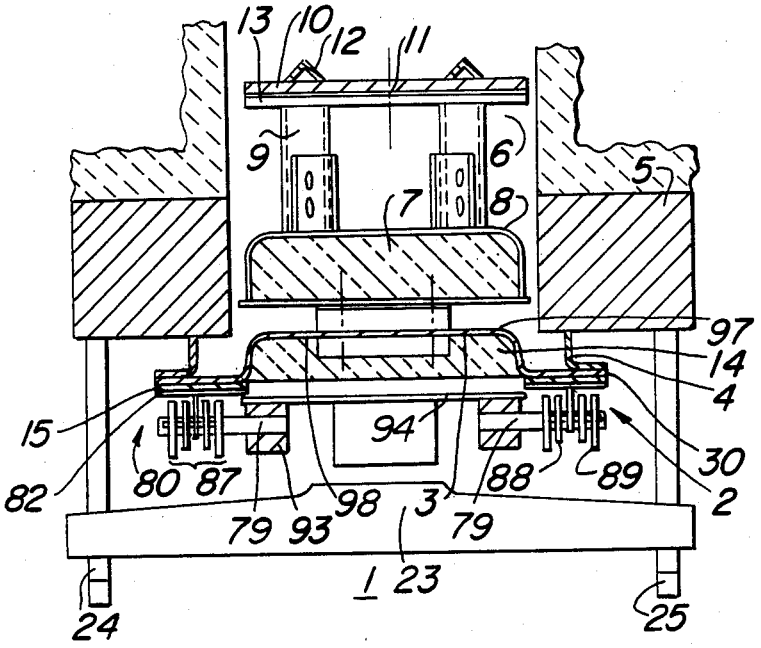
FIG. 1 shows a schematic transverse section through a coke oven door with a pressure-balancing lever system.

FIG. 1 shows a lightweight-construction coke oven door 1. The door body 2 of the flexible coke oven door 1 consists only of a thin-walled and flexible sealing plate 3. The thin-walled, sealing plate 3 is slightly deformed and bent at its edges in order to accept the knife edges 4, which knife edges are pressed against the door frame 5 by means of pressure elements or adjusting apparatus in order to seal the oven opening 6 or the interior of the oven against the atmosphere.

An insulating mat 7 in a protecting housing 8 is provided on the inner face of the sealing plate 3. The mat protects the thin-walled sealing plate 3 and also insures that the gas flowing upward in the space between the insulating mat 7 and the coking plate 10 supported by spacers 9 contains sufficient heat or that the gas transfers the heat only to the coking plate 10. Spacers 9 distributed over the height are connected with the protective housing 8 or with the plate that carries the housing. These spacers simultaneously support, as shown, the coking plates 10 and 13. The coking plates 10, 13 overlap one another, whereby screws serve as a connection 11. Reinforcing angles 12 are installed on the oven side of the coking plates 10, 13.

Angle-shaped knife edges 4 are installed on the oven side of the sealing plate 3. A distributor plate 15 is attached on the outside of the sealing plate. A plate covering the insulating mat 14 can be attached to the distributor plate 15. It is also possible to design the distributor plate 15 so that it also serves to cover the insulating mat 14.

In the design example shown in FIG. 1, a pressure-equalizing lever system 81 serving as a sealing frame 80 acts directly on the sealing plate 3. This pressure balancing lever system 81, which subsequently will be described in more detail, is supported by a suitable apparatus on locking bar 23. Pressure-balancing levers 19, 20 serve this purpose. These levers are connected by means of stay bolts 78, 79 with the bridge part 94 and its bolt mount 93. This bridge part 94 can be moved in the direction of the door frame or in the opposite direction by means of a spindle (not shown in FIG. 1) that serves as an adjusting unit 90. Necessary pressure is thereby applied on the pressure-balancing lever system 81 and/or 87, shown in FIG. 3, and thus on the sealing plate 3. The locking bars 23 lie in the locking hooks 24 or 25 and bear against them.

As FIG. 1 shows, the sealing plate 3 is protected by insulating mats 7 and 14 on the inner face 97 and outer face 98. The insulating mat 14 is installed in the indentation in the sealing plate 3, which indentation is made by bending the sealing plate at several appropriate points. This mat 14 protects the external apparatus of the coke oven door and insures even heating of the sealing plate 3.

Figure 2:
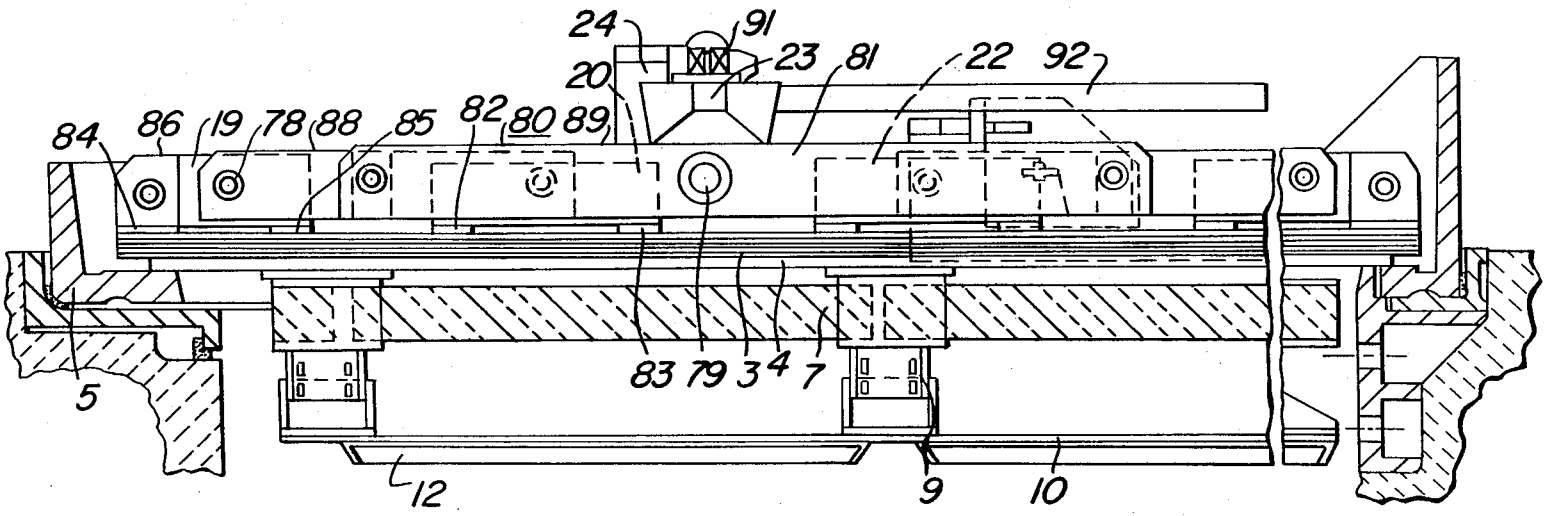
FIG. 2 shows a longitudinal section through a coke coke oven door with a pressure-balancing lever system.
Figure 3:
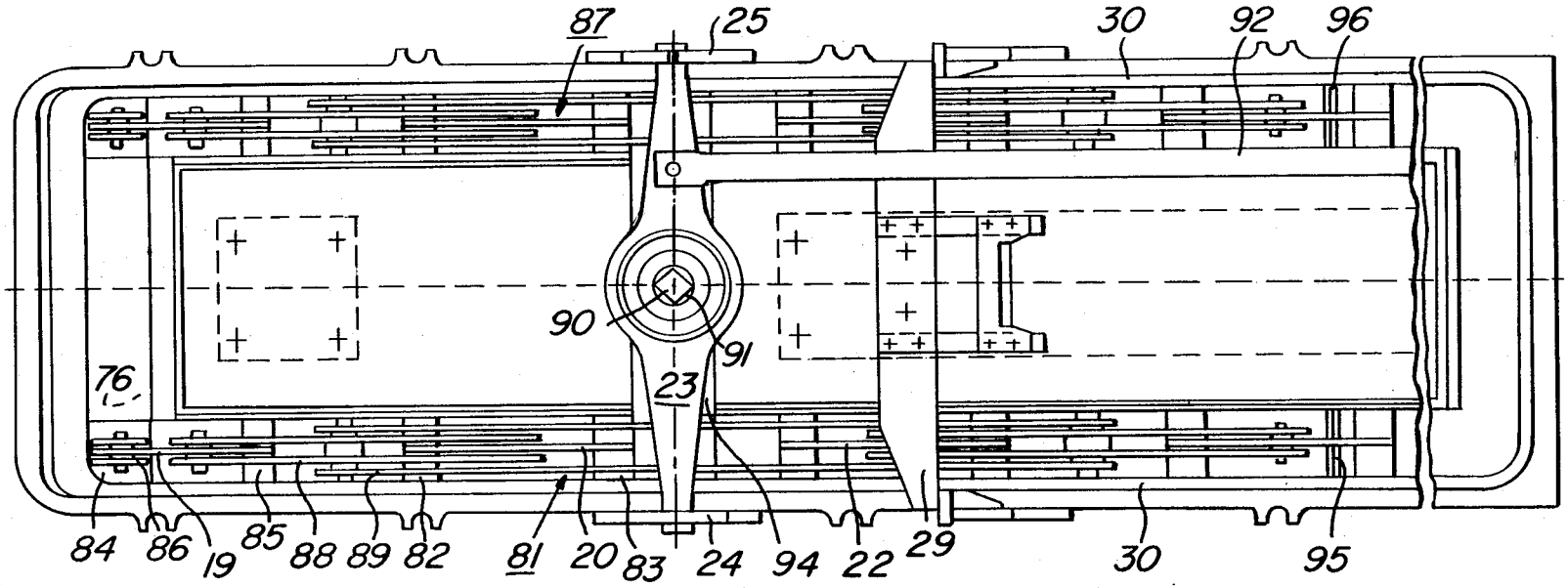
FIG. 3 shows a plan view of the coke oven door according to FIG. 1 and FIG. 2.

As shown in FIGS. 2 and 3, the sealing plate has a steady pressure exerted on both sides at the longitudinal edges 30 by means of the pressure-balancing lever system 81, 87 installed there. For this purpose, as FIGS. 1, 2 and 3 show, the pressure-balancing levers 19 and 20 are constructed with pads 82, 83, 84, 85. The pressure-balancing levers 19 and 20, act on the sealing plate through these pads and are supported through the brackets 86 and other appropriately constructed pressure-balancing levers of the pressure-balancing lever system 81, 87, which other pressure-balancing levers act as connecting lever 88 and distributing lever 89. All parts are flexibly interconnected, so that the desired flexibility of the entire pressure-balancing lever system is insured.

FIG. 2 shows a section and FIG. 3 a plan view of the coke oven door according to FIG. 1, whereby the square 91 is clearly shown, through which the spindle, which serves as an adjusting unit 90, acts on the bridge part 94 and thereby insures that this part bears against the locking bar 23. Numerals 24 and 25 denote the locking hooks within which the locking bar 23 is placed. The effective fitting of the individual parts of the pressure-balancing lever system 81 or 87 into one another is clearly seen here and in FIG. 3. The movement of one of the locking bars 23 is transferred to the other bar by means of the connecting bar, not shown, 92.

The part of the pressure-balancing lever system 81 associated with the upper edge 76, that is, the uppermost pad 84, is attached, preferably by welding, to the sealing plate 3. Thereby the entire pressure-balancing lever system 81 always maintains the same position, regardless of how often the coke oven door 1 is placed in front of the coke oven or removed from it. This purpose is also served by the slide guides 95, 96 which are located at the same elevation and can also be used to fix the pressure-balancing lever systems 81, 87.

FIGS. 2 and 3 also show that the individual pads 82, 83 or 84, 85 are installed at different distances from one another, whereby the shortest pressure-balancing lever 19 is installed in conjunction with the upper edge 76 or the lower edge, whereas toward the center the distance between the pads becomes progressively greater e.g. 82, 83.

The coking plate 10 held by spacers 9 is installed on the inner face 97 of the sealing plate 3 as shown in FIG. 1. The spacers 9 are made of two parts and are equipped with a series of corresponding holes, so that the distance between the coking plates 10, 13 and the sealing plate 3 or the insulating mat 7 can be varied as needed.

We claim:

1. A lightweight, flexible door assembly for closing the end of a coke oven having an opening defined by an oven door frame, with a sealing surface thereon and adjacent door locking hooks, said door comprising:

(A) a flexible sealing plate door body having:
  (1) an inner face,
  (2) an outer face,
  (3) a first longitudinal edge; and
  (4) a second longitudinal edge;

(B) sealing means associated with said sealing plate door body, adjacent the periphery thereof;

(C) a plurality of flexible pressure-balancing lever systems designed and constructed to exert pressure at a plurality of spaced locations on the outer face of said sealing plate door body, adjacent the first and second longitudinal edges thereof, each said system comprising:
  (1) a plurality of flexibly interconnected levers;

(D) a plurality of locking-bar means, each adjustably and flexibly connected to two of said pressure-balancing lever systems, designed and constructed to engage said door locking hooks and hold said door in position against said door frame and to exert pressure on each said pressure-balancing lever system and therethrough to a plurality of spaced locations adjacent the first and second longitudinal edges on the outer face of said sealing plate door body and upon said sealing means, whereby said sealing means is pressed against said oven door frame to seal said oven opening against the atmosphere.

2. The lightweight, flexible door assembly of claim 1 wherein said door further comprises:

(A) a coking plate assembly extending into said oven, and (B) support means extending between the inner face of said sealing plate door body and said coking plate assembly.

3. A lightweight, flexible door assembly for closing the end of a coke oven having an opening defined by an oven door frame, with a sealing surface thereon and adjacent door locking hooks, said door comprising:

(A) a coking plate assembly extending into said oven;

(B) a flexible, thin sealing plate door body having:
  (1) an inner face,
  (2) an outer face,
  (3) a first longitudinal edge, and
  (4) a second longitudinal edge;

(C) support means connecting at one end thereof with the inner face of said sealing plate door body and at the other end thereof with said coking plate assembly;

(D) sealing means associated with said sealing plate door body, adjacent the periphery thereof;

(E) a plurality of flexible pressure-balancing lever systems designed and constructed to exert pressure at a plurality of spaced locations on the outer face of said sealing plate door body, adjacent the first and second longitudinal edges thereof, each said system comprising:

(1) a plurality of pressure-balancing levers, (2) a plurality of connecting-levers, and (3) at least one distributing lever;

(F) a plurality of locking-bar means, each adjustably and flexibly connected to two of said pressure-balancing systems, designed and constructed to engage said locking hooks and hold said door in position against said door frame and to exert pressure on said pressure-balancing lever system and therethrough to a plurality of spaced locations adjacent the first and second longitudinal edges on the outer face of said sealing plate door body and upon said sealing means, whereby said sealing means is pressed against said oven door frame to seal said oven opening against the atmosphere.

4. The lightweight, flexible door assembly of claim 3 wherein each of said pressure-balancing levers has two pads thereon bearing against the outer face of said sealing plate and at least two of said flexible pressure-balancing lever systems each has two pressure balancing levers of different lengths.

5. A lightweight, flexible door assembly for closing the end of a coke oven having an opening defined by an oven door frame, with a sealing surface thereon and adjacent door locking hooks, said door comprising:

(A) a coking plate assembly extending into said oven;

(B) a flexible sealing plate door body having:

(1) an upper end, (2) a lower end, (3) an inner face, (4) an outer face, (5) a first longitudinal edge, and (6) a second longitudinal edge;

(C) support means connecting at one end thereof with the inner face of said sealing plate door body and at the other end thereof with said coking plate assembly;

(D) sealing means associated with the inner face of said sealing plate door body, adjacent the periphery thereof;

(E) at least four flexible pressure-balancing lever systems, two adjacent the first longitudinal edge of said sealing plate door body and two adjacent the second longitudinal edge of said sealing plate door body, each of said systems comprising:

(1) four pressure-balancing levers, each said lever having at least two pads, one adjacent each end thereof, flexibly interconnected with, (2) four connecting levers flexibly interconnected with, (3) two distributing levers;

(F) at least two locking-bar-distance-adjusting means, each flexibly connected to two of said pressure-balancing lever systems, designed and constructed to engage said door locking hooks and hold said door in position against said door frame and to exert pressure on said pressure-balancing lever systems and through the pads on the pressure-balancing levers thereof to a plurality of spaced locations adjacent the first and second longitudinal edges on the outer face of said sealing plate door body and through said plate door body to said sealing means, whereby said sealing means is pressed against said oven door frame to seal said oven opening against the atmosphere.

6. The lightweight flexible door assembly of claim 5 wherein said pressure-balancing lever systems adjacent the upper and lower ends of said sealing plate each has a pressure-balancing lever of shorter length than the other pressure-balancing levers thereof, each said shorter lever being adjacent one of said door ends, whereby the pressure exerted by each said pressure-balancing lever system on the outer face of said sealing plate door body and through said plate to said sealing means is greater adjacent the ends of said sealing plate than elsewhere on said plate.

7. The lightweight flexible door assembly of claim 5 wherein each said locking-bar-distance adjusting means comprises:

(1) a locking bar designed and constructed to engage two of said door locking hooks, (2) a bridge means flexibly connected to two of said pressure-balancing lever systems, and (3) a distance adjusting means connected between said locking bar and said bridge means.

8. The lightweight flexible door assembly according to claim 5 or 7 wherein each said pressure-balancing lever system comprises pressure balancing levers, connecting levers and distributing levers that are different in length.

9. The lightweight flexible door assembly of claim 5 wherein each said pressure-balancing lever system has one pressure balancing lever of shorter length than said other three balancing levers and said shorter lever is installed in conjunction with one end of said flexible sealing plate door body to exert greater pressure at said end than elsewhere on said sealing plate door body.

10. The lightweight door assembly of claim 5 wherein distributor plate means is positioned between the outer face of said sealing plate door body and the pads of the pressure-balancing levers of said pressure-balancing lever systems.

* * * * *

UNITED STATES PATENT AND TRADEMARK OFFICE

CERTIFICATE OF CORRECTION

PATENT NO. : 4,647,342

DATED : March 3, 1987

INVENTOR(S) : Wilhelm Stog, et al.

It is certified that error appears in the above-identified patent and that said Letters Patent is hereby corrected as shown below:

In Column 2, line 62 of the Patent, change "lever" to --levers--.

In Column 2, line 66 of the Patent, change "levels" to --levers--.

In Column 3, line 9 of the Patent, change "levers" to --lever--.

In Column 3, line 21 of the Patent, change "pressurebalanceing" to --pressure-balancing--.

In Column 3, line 42 of the Patent, change "link" to--lever--.

In Column 5, line 6 of the Patent, change "equalizing" to --balancing--.

In Column 5, lines 31 and 32 of the Patent, change "system" to --systems--.

UNITED STATES PATENT AND TRADEMARK OFFICE

CERTIFICATE OF CORRECTION

PATENT NO. : 4,647,342

DATED : March 3, 1987

INVENTOR(S) : Wilhelm Stog, et al.

It is certified that error appears in the above-identified patent and that said Letters Patent is hereby corrected as shown below:

In Column 5, line 40 of the Patent, change "as" to --on--.

In Column 5, line 54 of the Patent, after "bar" insert --not shown--.

In Column 5, line 55 of the Patent, delete ", not shown,".

Signed and Sealed this

Seventeenth Day of November, 1987

*Attest:*

DONALD J. QUIGG

*Attesting Officer*

*Commissioner of Patents and Trademarks*